United States Patent [19]

Cheung

[11] Patent Number: 4,780,118

[45] Date of Patent: Oct. 25, 1988

[54] PROCESS AND APPARATUS TO PRODUCE ULTRA HIGH PURITY OXYGEN FROM A LIQUID FEED

[75] Inventor: Harry Cheung, Buffalo, N.Y.

[73] Assignee: Union Carbide Corporation, Danbury, Conn.

[21] Appl. No.: 78,852

[22] Filed: Jul. 28, 1987

[51] Int. Cl.[4] ..... F25J 3/02

[52] U.S. Cl. ..... 62/11; 62/27; 62/31

[58] Field of Search ..... 62/9, 11, 17, 20, 23, 62/24, 27, 28, 31, 32, 33, 34, 41

[56] References Cited

U.S. PATENT DOCUMENTS

| | | | |
|---|---|---|---|
| 2,519,892 | 8/1950 | Dennis | 62/175.5 |
| 2,815,650 | 12/1957 | McIntire et al. | 62/34 X |
| 3,363,427 | 1/1968 | Blanchard et al. | 62/21 |
| 3,620,032 | 11/1971 | Simonet | 62/28 |
| 3,718,006 | 2/1973 | Ranke et al. | 62/17 |
| 4,410,343 | 10/1983 | Ziemer | 62/34 X |
| 4,433,990 | 2/1984 | Olszewski | 62/28 X |
| 4,448,595 | 5/1984 | Cheung | 62/34 X |
| 4,526,595 | 7/1985 | McNeil | 62/28 |
| 4,543,115 | 9/1985 | Agrawal et al. | 62/34 X |
| 4,560,397 | 12/1985 | Cheung | 62/28 |
| 4,615,716 | 10/1986 | Cormier et al. | 62/24 |

OTHER PUBLICATIONS

Smith et al., "Distillation", Section 13, Chemical Engineers Handbook, pp. 1-3, 1973.

Ruhemann, "The Separation of Gases", Oxford Press, pp. 163-165, 1949.

*Primary Examiner*—Steven E. Warner

*Attorney, Agent, or Firm*—Stanley Ktorides

[57] ABSTRACT

A process and apparatus to produce ultra high purity oxygen comprising serially oriented stripping and absorbing columns having defined flow stream relationships.

23 Claims, 2 Drawing Sheets

PROCESS AND APPARATUS TO PRODUCE ULTRA HIGH PURITY OXYGEN FROM A LIQUID FEED

TECHNICAL FIELD

This invention relates generally to the production of ultra high purity oxygen and more particularly to the production of ultra high purity oxygen from a liquid feed stream.

BACKGROUND ART

Commercial grade high purity oxygen has a nominal purity of 99.5 percent. Generally commercial grade high purity oxygen is produced by the well known cryogenic fractional distillation of air, most often using a stacked double column arrangement. The commercially available high purity oxygen is suitable for use in a great many applications.

Commercial grade high purity oxygen contains a small amount of impurities. The impurities include both light impurities having a vapor pressure greater than oxygen, and heavy impurities having a vapor pressure less than oxygen. Occasionally oxygen is required which has significantly less impurities than the commercially available high purity oxygen. In these instances, high purity oxygen has heretofore been upgraded to ultra high purity oxygen by means of catalytic combustion.

The electronics industry requires the use of ultra high purity oxygen for many applications. However, the conventional catalytic combustion method for producing ultra high purity oxygen is not suitable because of the consequent production of particulates generated from the granulated catalyst.

It is desirable therefore to have a process and apparatus to produce ultra high purity oxygen without need for the use of catalytic combustion.

Accordingly, it is an object of this invention to produce ultra high purity oxygen without need for the use of catalytic combustion.

It is a further object of this invention to produce ultra high purity oxygen by the upgrading of high purity oxygen produced by the cryogenic fractional distillation of air.

SUMMARY OF THE INVENTION

The above and other objects which will become apparent to those skilled in the art upon a reading of this disclosure are attained by the present invention one aspect of which is:

A process to produce ultra high purity oxygen from a liquid feed comprising:

(a) introducing feed liquid containing oxygen, light impurities and heavy impurities into a stripping column;

(b) passing feed liquid down the stripping column and stripping light impurities from downflowing liquid into upflowing vapor;

(c) vaporizing resulting liquid, passing a first vapor portion thereof into an absorbing column, and passing a second portion thereof up the stripping column as said upflowing vapor;

(d) passing first vapor portion up the absorbing column and absorbing heavy impurities from ascending vapor into descending liquid to produce ultra high purity oxygen vapor;

(e) condensing ultra high purity oxygen vapor and passing resulting ultra high purity oxygen liquid down the absorbing column as descending liquid; and (f) recovering product ultra high purity oxygen.

Another aspect of this invention is:

Apparatus to produce ultra high purity oxygen from a liquid feed comprising:

(a) a stripping column having a reboiler;

(b) an absorbing column having a condenser;

(c) conduit means from the vaporizing side of the reboiler to the lower portion of the absorbing column;

(d) conduit means from the condensing side of the reboiler to the upper portion of the absorbing column; and (e) means to recover fluid from the absorbing column.

The term, "column", as used herein means a distillation or fractionation column or zone, i.e., a contacting column or zone wherein liguid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For a further discussion of distillation columns see the Chemical Engineers' Handbook. Fifth Edition, edited by R. H. Perry and C. H. Chilton, McGraw-Hill Book Company, New York, Section 13, "Distillation" B. D. Smith et al, page 13-3 *The Continuous Distillation Process.* The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

The term "indirect heat exchange", as used herein means the bringing of two fluid streams into heat exchange relation without any physical contact or intermixing of the fluids with each other.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "stripping column" means a column operated with sufficient vapor upflow relative to liquid downflow to achieve separation of a volatile component such as argon from the liquid into the vapor in which the volatile component such as argon becomes progressively richer upwardly.

As used herein, the term "absorbing column" means a column operated with sufficient liquid downflow relative to vapor upflow to achieve separation of a less volatile component such as methane from the vapor into the liquid in which the less volatile component such as methane becomes progressively richer downwardly.

As used herein, the term "reboiler" means a heat exchange device which generates column upflow vapor from column bottom liquid.

As used herein, the term "condenser" means a heat exchange device which generates column downflow liquid from column top vapor.

As used herein, the term "vaporizing side" means that side of an indirect heat exchange device upon which saturated liquid undergoes phase change to saturated vapor.

As used herein, the term "condensing side" means that side of an indirect heat exchange device upon which saturated vapor undergoes phase change to saturated liquid.

DETAILED DESCRIPTION

Figure 1:
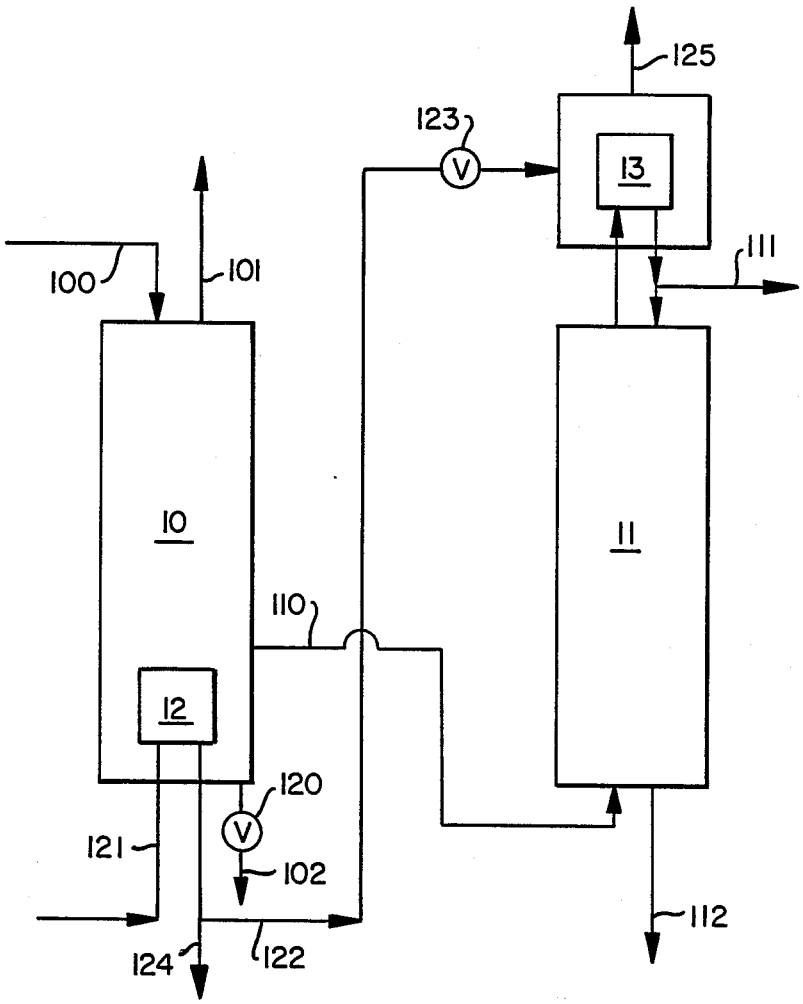
FIG. 1 is a schematic flow diagram of one preferred embodiment of the invention wherein the invention is employed as an addition to a cryogenic distillation air separation plant.

The invention will be discussed in detail with reference to the drawings. In the drawings the same numerals are used for the elements common to both embodiments.

Referring now to the drawings, feed liquid 100 is introduced, preferably at the top, into stripping column 10 having reboiler 12. In the embodiments illustrated in the drawings, reboiler 12 is shown as being physically within stripping column 10. However this arrangement is not necessary and the reboiler for the stripping column could be physically outside the stripping column and connected thereto by appropriate piping. The stripping column operates at a pressure within the range of from 10.3 to 73.5 pounds per square inch absolute (psia) (0.7 to 5.0 atmospheres), preferably within the range of from 14.7 to 68.8 psia (1.0 to 4.0 atmospheres).

Feed liquid 100 is comprised primarily of oxygen, generally at a concentration within the range of from 95 to 99.9 percent. Typically feed liquid 100 is commercial grade high purity oxygen having a concentration of about 99.5 percent oxygen. Feed liquid 100 also contains light impurities, such as argon, nitrogen, hydrogen and helium, which have a higher vapor pressure or volatility than oxygen, and heavy impurities, such as krypton, xenon and hydrocarbons, which have a lower vapor pressure or volatility than oxygen. Feed liquid 100 may be from any source. In the embodiment of FIG. 1 the feed liquid 100 is taken directly from a cryogenic air separation plant. In the case where the cryogenic air separation plant is of the double column type, preferably the feed liquid is taken from a point above the main condenser. Other sources of feed liquid include cryogenic storage tanks and reservoirs which are independent of an air separation plant.

The feed liquid is passed down the stripping column and light impurities are stripped from the downflowing liquid into upflowing vapor. As used herein "impurities" means both one specie of impurity as well as more than one specie. Resulting stripped liquid is vaporized by indirect heat exchange on the vaporizing side of reboiler 12. Most of the resulting stripped liquid is so vaporized while a small remaining portion thereof is removed through valve 120 and drain 102. The drain liquid, containing some heavy impurities, may be discarded or returned to the host air separation plant to conserve its refrigeration.

Reboiler 12 is driven by any suitable fluid. In the embodiment of FIG. 1 reboiler 12 is driven by condensing vapor 121 from a cryogenic air separation plant. In the case of a double column plant, condensing vapor 121 would preferably be taken from the lower column, i.e., the higher pressure column. In the standalone embodiment illustrated in FIG. 2, reboiler 12 is driven by condensing vapor 31 which is derived from a stream or streams internal to the invention.

A first portion of the vaporized liquid from the vaporizing side of reboiler 12 is passed as stream 110, by any suitable conduit means, into the lower portion of absorbing column 11, preferably at the bottom of absorbing column 11. A second portion of the resulting vaporized liquid from the vaporizing side of reboiler 12 is passed up stripping column 10 as the upflowing vapor into which light impurities are stripped from the downflowing liquid. The resulting vapor containing stripped light impurities is removed from stripping column 10 as stream 101. In the embodiment illustrated in FIG. 1, stream 101 is passed into the cryogenic air separation plant; in the preferred double column case, stream 101 is passed into the upper column at a point above the point from which the feed liquid is taken. In the standalone embodiment illustrated in FIG. 2, stream 101 preferably forms part of a recycle which is used to drive reboiler 12.

Stripping column 10 is operated such that argon stripping factor S preferably exceeds 1.0 and most preferably exceeds 1.1. Argon stripping factor $S=KV/L$ where V is the vapor molar flow in the stripping column, L is the liquid molar flow in the stripping column, and K is the ratio of the mole fraction of argon impurity in the gas phase and the mole fraction of argon impurity in the liguid phase at thermodynamic eguilibrium. When operated in this manner, stripping column 10 serves to reduce the concentration of argon from feed 100 to stream 110 by about three orders of magnitude. Since argon is the least volatile of the light impurities, all other light impurities will be reduced in concentration by operation of stripping column by an even greater factor.

Vapor in stream 110 is passed into and up absorbing column 11 having condenser 13. In the embodiments illustrated in the drawings, condenser 13 is shown as being physically outside of the main part of absorbing column 11. However this arrangement is not necessary and the condenser could be within the main part of the absorbing column. That is, the condenser forms part of the absorbing column whether or not it is physically within the main column section. Fluid is passed by conduit means from the condensing side of reboiler 12 to the upper portion of absorbing column 11, e.g. to the vaporizing side of the condenser, to drive condenser 13. The absorbing column operates at a pressure preferably within the range of from 10.3 to 73.5 psia (0.7 to 5.0 atmospheres). The vapor is passed up the absorbing column and heavy impurities are absorbed from the ascending vapor into descending liquid thus producing ultra high purity oxygen vapor. At least some of the ultra high purity oxygen vapor is passed to the condensing side of condenser 13. Some of the ultra high purity oxygen vapor may be recovered as product ultra high purity oxygen.

Ultra high purity oxygen liquid condensed in condenser 13 is than passed down absorbing column 11 as the descending liquid into which heavy impurities are absorbed. Prior to being passed down absorbing column 11, a portion of the liquid ultra high purity oxygen may be recovered as product ultra high purity oxygen. Both of FIGS. 1 and 2 illustrate the embodiment wherein the product ultra high purity oxygen is recovered as liquid stream 111.

Figure 2:
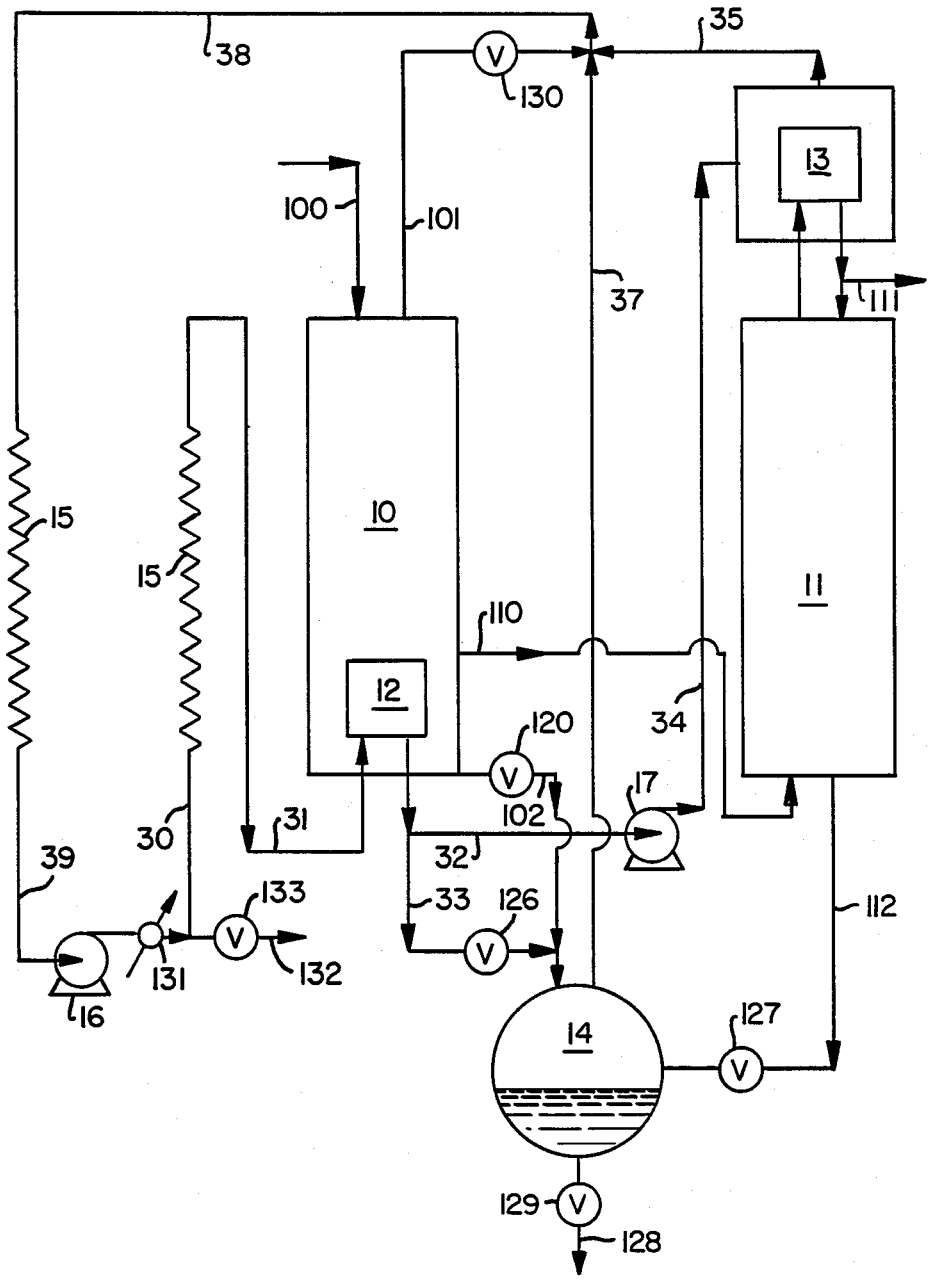
FIG. 2 is a schematic flow diagram of another preferred embodiment of the invention wherein the invention is employed standing alone.

Product ultra high purity oxygen of this invention may be recovered as gas prior to condensation in condenser 13 or, as illustrated in FIGS. 1 and 2, it may be recovered as liquid after the condensation in condenser 13. In addition, the product ultra high purity oxygen may be recovered as both gas and liquid from both locations. Typically the product ultra high purity oxygen of this invention will have an oxygen purity of at least 99.999 percent and may have a purity of up to 99.99999 percent.

Condenser 13 is driven by any suitable means. Preferably condenser 13 is driven by passing at least some of the condensed fluid from the condensing side of reboiler 12 by conduit means to the vaporizing side of condenser 13 wherein the fluid vaporizes to effect the aforesaid condensation of the ultra high purity oxygen. In the embodiment illustrated in FIG. 1, a portion 122 of the condensed fluid from reboiler 12 is passed through valve 123 and into the vaporizing side of condenser 13, while the remainder 124 is passed out of the process. The resulting vaporized fluid is passed from the vaporizing side of condenser 13 as stream 125 and into the cryogenic air separation plant. In the case where the air separation plant is of the double column type, stream 125 is preferably passed into the upper column. In the standalone embodiment illustrated in FIG. 2, a portion 32 of the condensed fluid from reboiler 12 is pumped by pump 17 and passed as stream 34 into the vaporizing side of condenser 13, while the remainder is passed out as stream 33. The resulting vaporized fluid is passed out of the vaporizing side of condenser 13 as stream 35.

Descending liquid within the absorbing column containing absorbed heavy impurities is removed from the absorbing column as stream 112. In the embodiment illustrated in FIG. 1, stream 112 is passed into the cryogenic air separation plant; in the preferred double column case, stream 112 is passed into the plant at the main condenser. In the standalone embodiment illustrated in FIG. 2, stream 112 preferably forms recycle fluid.

Absorbing column 11 is operated such that methane absorbing factor A preferably exceeds 1.0 and most preferably exceeds 1.1. Methane absorbing factor $A=1/kv$ where 1 is the liquid molar flow in the absorbing column, v is the vapor molar flow in the absorbing column, and k is the ratio of the mole fraction of methane impurity in the gas phase and the mole fraction of methane impurity in the liquid phase at thermodynamic equilibrium. When operated in this manner, absorbing column 11 serves to reduce the concentration of methane from stream 110 to the product ultra high purity oxygen, such as might be recovered in stream 111, by about three orders of magnitude. Since methane is the most volatile of the heavy impurities, all other heavy impurities will be reduced in concentration by operation of the absorbing column by an even greater factor.

Either of stripping column 10 or absorbing column 11, or both, may be comprised of a series of vertically spaced trays or of column packing. Those skilled in the mass transfer art are familiar with the many types of trays and column packing available and no further detailed discussion is necessary here.

In the standalone embodiment of this invention the fluids to drive the reboiler and the condenser are generated internally. Referring now to the embodiment illustrated in FIG. 2, liquid reservoir or tank 14 is fed by at least one, and preferably three, internal streams by conduit means. One reservoir feed stream is condensed fluid 33 from the condensing side of reboiler 12 which passes through valve 126 and into reservoir 14. Another reservoir feed stream is drain 102 from the lower portion, preferably the bottom, of stripping column 10. A third reservoir feed stream is stream 112 from the lower portion, preferably the bottom, of absorbing column 11 which is passed through valve 127 and into reservoir 14.

In reservoir 14 vapor is flashed off the liquid and is passed out of the reservoir as stream 37. Flash vapor is produced due to throttling of saturated liquid across valves 120, 126 and 127. The flashed vapor is then passed, such by conduit means, to the condensing side of reboiler 12 to drive reboiler 12. Preferably, as will be explained more fully infra, streams 35 and 101 are combined with flashed vapor 37 to form stream 38 which is recycled to the condensing side of reboiler 12.

Liquid stream 128 is passed out of reservoir 14 through valve 129. This stream would generally have an oxygen concentration of at least 99.5 percent and is recovered as commercial high purity oxygen. This stream is not recycled in order to prevent excess heavy impurity buildup.

In addition to stream 37, either one or both of two other streams could be passed, such as by conduit means, to the vaporizing side of reboiler 12. One such stream is stream 101 taken from the upper portion, preferably the top, of stripping column 10. The other stream is stream 35 which is vaporized fluid from the vaporizing side of condenser 13. Preferably all three of streams 37, 35 and 101 are passed to the condensing side of reboiler 12 tO drive reboiler 12. FIG. 2 illustrates a preferred embodiment wherein these three stream are combined, after stream 101 passes through valve 130, to form stream 38.

Stream 38 is warmed by indirect heat exchange by passage through heat exchanger 15. Warmed stream 39 is compressed by compressor 16 and aftercooled by cooler 131. Stream 39 is then passed as reliquefaction feed stream 30 through heat exchanger 15 wherein it is cooled by indirect heat exchange against warming stream 38. The cooled reliquefaction stream emerges from heat exchanger 15 and is passed as stream 31 to the condensing side of reboiler 12 to drive reboiler 12. A portion 132 may be passed out of stream 39 through valve 133 prior to its becoming reliquefaction stream 30. The flowrate of stream 132 depends upon heat leakage into the process and could be nearly zero if a significant amount of the product ultra high purity oxygen is recovered in gaseous form.

The results of a computer simulation of the invention carried out with the embodiment illustrated in FIG. 1 are presented in Table 1. The stream numbers in Table 1 correspond to those of FIG. 1. The abreviation CFH stands for cubic foot per hour, at standard conditions of 1 atmosphere and 70 degrees Farenheit, °K stands for degrees Kelvin, and PPM stands for parts per million. The stripping column operated at an argon stripping factor of 1.2 and had 33 equilibrium stages or theoretical trays and the absorbing column operated at a methane absorbing factor of 1.2 and had 31 equilibrium stages or theoretical trays. The invention was operated as an addition to a double column air separation plant. As can be seen, the argon impurity is reduced from 4000 to 5 ppm and the methane impurity is reduced from 8.1 to 0.03 ppm.

TABLE 1

| Stream No. | Flow, CFH | Pressure, PSIA | Temperature °K. | Impurity, PPM Argon | Methane |
|---|---|---|---|---|---|
| 100-liquid | 8250 | 25.4 | 95.8 | 4000 | 8.1 |
| 101-gas | 6620 | 25.4 | 95.8 | 4986 | 2.5 |
| 102-liquid | 30 | 28.0 | 96.9 | 4 | 94.5 |
| 110-gas | 1600 | 28.0 | 96.9 | 4 | 29.5 |
| 111-liquid | 1000 | 25.4 | 95.8 | 5 | 0.03 |
| 112-liquid | 600 | 28.0 | 96.5 | 2.5 | 78.6 |

A major advantage of the embodiment of the invention such as is illustrated in FIG. 1 is that there is no need for additional oxygen compression or additional heat pump compression. A major advantage of the standalone embodiment of the invention such as is illustrated in FIG. 2 is that the state of oxygen is largely preserved, i.e. nearly all of the oxygen can be removed from the process in liquid form. This advantage is demonstrated by the data presented in Table 2 which is a computer simulation of the invention of the embodiment illustrated in FIG. 2. The stream numbers in Table 2 correspond to those of FIG. 2.

TABLE 2

| Stream No. | Flow, CFH | Pressure, (PSIA) | Temperature °K. |
|---|---|---|---|
| 30 | 8490 | 37 | 300 |
| 132 | 90 | 37 | 300 |
| 31 | 8490 | 34 | 99.5 |
| 32 | 1650 | 33.4 | 98.9 |
| 33 | 6840 | 33.4 | 98.9 |
| 34 | 1650 | 45 | 100 |
| 35 | 1650 | 21 | 93.8 |
| 128 | 7160 | 22 | 94.3 |
| 37 | 310 | 22 | 94.3 |
| 38 | 8580 | 21 | 95 |
| 39 | 8580 | 18 | 295 |

The stripping and absorbing columns were the same as, and were operated in manners similar to those, described with the embodiment illustrated in FIG. 1, and values for stream numbers 100, 101, 102, 110, 111 and 112 were the same as those given in Table 1. As can be seen, oxygen effluent streams 111 and 128 equal 8160 CFH while feed stream 100 equals 8250 CFH resulting in liguid state conservation of about 99 percent.

Although the process and apparatus of this invention have been described in detail with reference to certain preferred embodiments, those skilled in the art will recognize that there are other embodiments of this invention within the spirit and scope of the claims.

I claim:

1. A process to produce ultra high purity oxygen from a liquid feed comprising:

(a) introducing feed liquid containing oxygen, light impurities and heavy impurities into a stripping column;

(b) passing feed liquid down the stripping column and stripping light impurities from downflowing liquid into upflowing vapor;

(c) vaporizing resulting liquid, passing a first vapor portion thereof into an absorbing column, and passing a second portion thereof up the stripping column as said upflowing vapor;

(d) passing first vapor portion up the absorbing column and absorbing heavy impurities from ascending vapor into descending liquid to produce ultra high purity oxygen vapor;

(e) condensing ultra high purity oxygen vapor and passing resulting ultra high purity oxygen liquid down the absorbing column as descending liquid, and (f) recovering product ultra high purity oxygen.

2. The process of claim 1 wherein the product ultra high purity oxygen has an oxygen concentration of at least 99.999 percent.

3. The process of claim 1 wherein product ultra high purity oxygen is recovered as vapor prior to the condensation of step (e).

4. The process of claim 1 wherein the product ultra high purity oxygen is recovered as liguid after the condensation of step (e).

5. The process of claim 1 wherein the stripping column is operated so that the argon stripping factor S is greater than 1 where $S=KV/L$, V is the vapor molar flow in the stripping column, L is the liquid molar flow in the stripping column, and K is the ratio of the mole fraction of argon impurity in the gas phase and the mole fraction of argon impurity in the liquid phase at thermodynamic equilibrium.

6. The process of claim 1 wherein the absorbing column is operated so that the methane absorbing factor A is greater than 1 where $A=1/kv$, 1 is the liquid molar flow in the absorbing column, v is the vapor molar flow in the absorbing column, and k is the ratio of the mole fraction of methane impurity in the gas phase and the mole fraction of methane impurity in the liquid phase at thermodynamic equilibrium.

7. The process of claim 1 wherein the feed liquid is taken from a double column cryogenic air separation plant at a point above the main condenser and vapor containing stripped light impurities is passed from the upper portion of the stripping column into the cryogenic air separation plant at a point above the point from which the feed liquid is taken.

8. The process of claim 1 wherein the stripping column is operated at a pressure within the range of from 10.3 psia to 73.5 psia.

9. The process of claim 1 wherein the absorbing column is operated at a pressure within the range of form 10.3 psia to 73.5 psia.

10. The process of claim 1 further comprising carrying out the vaporization of step (c) by indirect heat exchange with condensing fluid and passing at least some of the resulting condensed fluid in indirect heat exchange with ultra high purity oxygen to carry out the condensation of step (e) thus producing vaporized fluid.

11. The process of claim 10 wherein the condensing fluid is taken from a cryogenic air separation plant and the vaporized fluid is returned to the cryogenic air separation plant.

12. The process of claim 10 further comprising passing at least one of:

(i) condensed fluid, (ii) liquid from the lower portion of the stripping column; and (iii) liquid from the lower portion of the absorbing column to a liquid reservoir, flashing vapor from the resulting liquid in the liquid reservoir, and condensing flashed vapor as the condensing fluid to carry out the vaporization of step (c).

13. The process of claim 12 further comprising adding at least one of:

(iv) vapor from the upper portion of the stripping column, and (v) vaporized fluid to the flashed vapor prior to the vaporization of step (c).

14. The process of claim 12 further comprising recovering liquid from the liquid reservoir as product liquid oxygen.

15. Apparatus to produce ultra high purity oxygen from a liquid feed comprising:

(a) a stripping column having a reboiler;

(b) an absorbing column having a condenser;

(c) conduit means from the vaporizing side of the reboiler to the lower portion of the absorbing column;

(d) conduit means from the condensing side of the reboiler to the vaporizing side of the condenser; and (e) means to recover fluid from the absorbing column.

16. The apparatus of claim 15 wherein the conduit means from the vaporizing side of the reboiler passes to the bottom of the absorbing column.

17. The apparatus of claim 15 further comprising a liquid resrvoir in flow communication by conduit means with at least one of:

(i) the condensing side of the reboiler, (ii) the lower portion of the stripping column, and (iii) the lower portion of the absorbing column.

18. The apparatus of claim 17 further comprising means to pass vapor from the liquid reservoir to the condensing side of the reboiler and means to pass liquid out from the liquid reservoir.

19. The apparatus of claim 18 further comprising means to pass vapor from the vaporizing side of the condenser to the condensing side of the reboiler.

20. The apparatus of claim 18 further comprising means to pass vapor from the upper portion of the stripping column to the condensing side of the reboiler.

21. Apparatus to produce ultra high purity oxygen from a liquid feed comprising:

(a) a stripping column having a reboiler;

(b) an absorbing column having a condenser;

(c) conduit means from the vaporizing side of the reboiler to the lower portion of the absorbing column;

(d) conduit means from the condensing side of the reboiler to the upper portion of the absorbing column; and (e) means to recover fluid from the absorbing column; further comprising (A) a liquid reservoir in flow communication by conduit means with at least one of:

(i) the condensing side of the reboiler, (ii) the lower portion of the stripping column; and (iii) the lower portion of the absorbing column; and (B) means to pass vapor from the liquid reservoir to the condensing side of the reboiler and means to pass liquid out from the liquid reservoir.

22. The apparatus of claim 21 further comprising means to pass vapor from the vaporizing side of the condenser to the condensing side of the reboiler.

23. The apparatus of claim 21 further comprising means to pass vapor from the upper portion of the stripping column to the condensing side of the reboiler.

* * * * *

UNITED STATES PATENT AND TRADEMARK OFFICE

CERTIFICATE OF CORRECTION

PATENT NO. : 4,780,118

DATED : October 25, 1988

INVENTOR(S) : Harry Cheung

It is certified that error appears in the above-identified patent and that said Letters Patent is hereby corrected as shown below:

In column 2, line 18 delete "liguid" and insert therefor --liquid--.

In column 4, line 32 delete "liguid" and insert therefor --liquid--.

In column 4, line 38 after "column" insert --10--.

In column 6, line 33 delete "tO" and insert therefor --to--.

In column 6, line 34 delete "stream" and insert therefor --streams--.

In column 7, line 44 delete "liguid" and insert therefor --liquid--.

In claim 4, line 2 delete "liguid" and insert therefor --liquid--.

In claim 9, line 2 delete "form" and insert therefor -- from --.

Signed and Sealed this

Fourteenth Day of March, 1989

*Attest:*

*Attesting Officer*

DONALD J. QUIGG

*Commissioner of Patents and Trademarks*